United States Patent [19]

Moss

[11] Patent Number: 5,005,381

[45] Date of Patent: Apr. 9, 1991

[54] HOSIERY FINISHING APPARATUS

[75] Inventor: Stanley H. Moss, Strabane, Northern Ireland

[73] Assignee: Adria Limited, Northern Ireland

[21] Appl. No.: 469,522

[22] PCT Filed: Sep. 19, 1988

[86] PCT No.: PCT/GB88/00760

§ 371 Date: Mar. 12, 1990

§ 102(e) Date: Mar. 12, 1990

[87] PCT Pub. No.: WO89/02947

PCT Pub. Date: Apr. 6, 1989

[30] Foreign Application Priority Data

Sep. 26, 1987 [GB] United Kingdom ..... 8722695

[51] Int. Cl.[5] ..... D04B 15/92

[52] U.S. Cl. ..... 66/149 S; 66/147

[58] Field of Search ..... 66/147, 149 S

[56] References Cited

U.S. PATENT DOCUMENTS

| | | | |
|---|---|---|---|
| 2,459,688 | 1/1949 | De Vever | 66/147 X |
| 3,686,726 | 8/1972 | Glaze, Jr. et al. | 66/147 X |
| 3,738,123 | 6/1973 | Mazzi | 66/149 S |
| 3,996,771 | 12/1976 | Routh et al. | 66/147 |
| 4,179,651 | 6/1979 | Coggins et al. | 66/147 |

FOREIGN PATENT DOCUMENTS

| | | | |
|---|---|---|---|
| 46-8478 | 3/1971 | Japan | 66/147 |
| 988934 | 1/1983 | U.S.S.R. | 66/147 |
| 1346924 | 2/1974 | United Kingdom | 66/147 |

*Primary Examiner*—Wm. Carter Reynolds
*Attorney, Agent, or Firm*—Wood, Phillips, Mason, Recktenwald & Vansante

[57] ABSTRACT

Apparatus for finishing hosiery, coupled to an individual knitting machine (2) includes a tube and valve (4, 6) for conveying completed articles to a chamber (10) formed by a sleeve heated by a resistance element (12) contained in the chamber (10). A pair of parallel control rods (18) move a slide (16), and articles are heated simultaneously with the knitting cycle of the next article to effect partial relaxation and shrinkage in step with the knitting machine.

3 Claims, 8 Drawing Sheets

HOSIERY FINISHING APPARATUS

DESCRIPTION TECHNICAL FIELD

The invention relates to apparatus for hosiery finishing which has a conditioning function and may be retrofitted onto knitting machines or incorporated as original equipment.

BACKGROUND ART

When knitting hose for ladies tights for example, the newly knitted fabric on the knitting machine is pulled down under tension, generally exerted by means of a suction take-down mechanism. When the article of hose is completed, it is pressed off from the knitting machine and a butterfly valve is switched to cause the pressed off article to be conveyed by suction through a U-tube to a dispenser. Upon arrival at the dispenser the article passes through a pivotable trap door and then falls into a bag.

The article is next subjected to a finishing procedure which includes in many cases the placing of a pair of knitted tubes on a Takatori automatic seaming machine. Here two tubes are slit, and the slit portions of adjacent tubes are linked to produce a pair of tights with a waistband, a body portion and a pair of leg portions. The article can then be stored, and/or subjected to a dyeing process to customer requirements. During the dyeing process the stockings or tights shrink because of the attendant treatment in hot water.

The articles pressed off from the knitting machine may alternatively be collected and subjected to a tumbling process involving steam, so to ensure that they are shrunk to a standard length, before the Takatori linking operation. However, even with this refinement, it has been difficult to ensure that the articles which are linked together have an equal length and can easily be placed on the Takatori machine. Furthermore, eveness of appearance is sometimes not provided by the tumbling process: indeed the tumbling process itself can contribute to variations in appearance.

Significant benefits in finishing can be obtained by subjecting the individual articles to a reproducible relaxation or shrinking treatment in association with individual knitting machines.

Patent Specification U.S. 3996771 (Routh) relates to such apparatus in which hosiery discharged from the knitting machine is transferred by air in timed sequence with the machine to a heat assembly for a prescribed time to set the stitches. The displacement of the knit garment is controlled by air jets, the operation of which is controlled by the pattern drum of the knitting machine.

THE INVENTION

According to the invention, a fan is connected through a valve to the take-down tube. (The take-down may in fact be upward). The valve has a first position in which the fan draws air through a by-pass from the take-down tube, and a second position in which the fan draws ar through a trap from the chamber and blows air through the by-pass into the take-down tube.

The chamber opening is controlled so that an individual article propelled by suction into the chamber is subjected to a relaxation or shrinking treatment whilst a subsequent article is being knitted. Tumbling and like disturbance of the fabric are avoided.

Shrunk articles collected from the trap can be collected in bags, which can be packed directly, or which can be stored. before further finishing treatments such as seaming together of the legs of a pair of tights on a Takatori machine, or on other forms of equipment.

Preferably, the articles are subjected in the chamber to a treatment such that partial relaxation is achieved. That is to say if the article were subjected to a subsequent tumbling treatment, it would be able to relax them further, beyond the stage reached in the chamber. By selecting appropriate conditioning parameters, it is possible to produce an article which has a reproducible length and diameter, like other articles knitted on the machine. The variation from article to article can be greatly reduced. The conditioning treatment can be sufficiently mild to allow the treatment to progress gradually through the article during the knitting cycle in a mildly compacted condition, so to produce an article which has a smooth, even stitch-structure, substantially free of local loop deformation.

It is simple to arrange replenishment of the chamber through synchronisation of the knitting cycle lo permit the necessary relaxation to be achieved at a low energy consumption. Advantageously, the replenishment from the chamber is controlled by a servo-operable barrier which can be moved selectively over the chamber outlet, and which is air-permeable to permit the next article to be conveyed by suction into the chamber and against the barrier. Preferably, the barrier is moved into the barring position immediately after press-off of the article being knitted, so that that article can be caught against the barrier, whilst allowing sufficient time for the previous article treated to move out of the chamber, and optionally to be collected through a pivotable trap door using the same period of suction air flow. Advantageously also, a further barrier can be selectively moved across the inlet of the chamber, which is not air permeable or permeable to a much lower degree. This can be used to reduce or prevent flow of air through the chamber whilst the conditioning treatment is in progress, preferably after the article has been blown out through the trap door. Thus a relativley low capacity electrical heating element can be used to obtain a significant degree of heating and shrinkage in the chamber in the period that the article dwells in the chamber, that is to say the duration of the knitting cycle.

The chamber is conveniently combined and formed as a continuation of the U-tube of the normal suction take-down mechanism of the knitting machine. The movement of the various barriers can be controlled by reference to the timing mechanism, whether mechanical or electrical in principle, already present on the knitting machine and can be incorporated so as not to interfere with the re-setting of the take-down mechanism required for the normal operation of the suction take-down mechanism. The relaxation or shrinkage treatment is preferably effected by electrical resistance heating, but it may be possible to achieve the same objective by steam, microwave or radio frequency treatment By using appartus according to the invention, it is possible to provide a degree of stretch in waistbands which exceeds that available from articles which have been tumbled, and which are therefore much more easy to treat on a Takatori seaming machine. The consistent body length facilitates initial location of the article during seaming. The partial constriction of the width of the article by shrinking, whilst avoiding the extremes of tumbling, aids in securing the articles on the various forms which may be used in the finishing of hosiery.

The fabric structure can be kept smooth and even, avoiding unintentional adhesion of loops which may occuur with more densely folded articles, and making possible an even and smooth appearance subsequent to dyeing.

DRAWINGS

FIGS. 4*a* to 4*e* show successive stages of operation.

Best Mode

Figure 1:
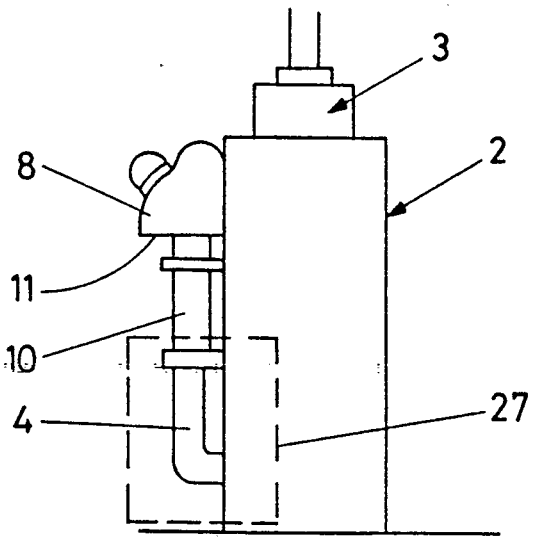
FIG. 1 is a schematic view of a knitting machine incorporating apparatus for finishing hosiery according to the invention.

In FIG. 1, a knitting machine 2 has a cylinder 3 with needles (not shown) for knitting a tubular article of hosiery for use in making ladies tights or stockings. Conventional parts of the suction take-down mechanism have not been described in detail except insofar as relevant for explaining the invention. A fan 5 (FIG. 2) is connected to a downward leg 4*a* of a U-tube 4 through a by-pass 9. The timing of the operation in suction take-down is controlled by a butterfly valve 6. At the end of an upward leg 4*b* of the U-tube 4 there is a trap or dispenser 8 with an internal screen connected to a suction hose 7. This enables the article to be sucked into the trap 8, ready for removal through a door 11 for reception into a box or bag 27 (FIG. 1).

Figure 2:
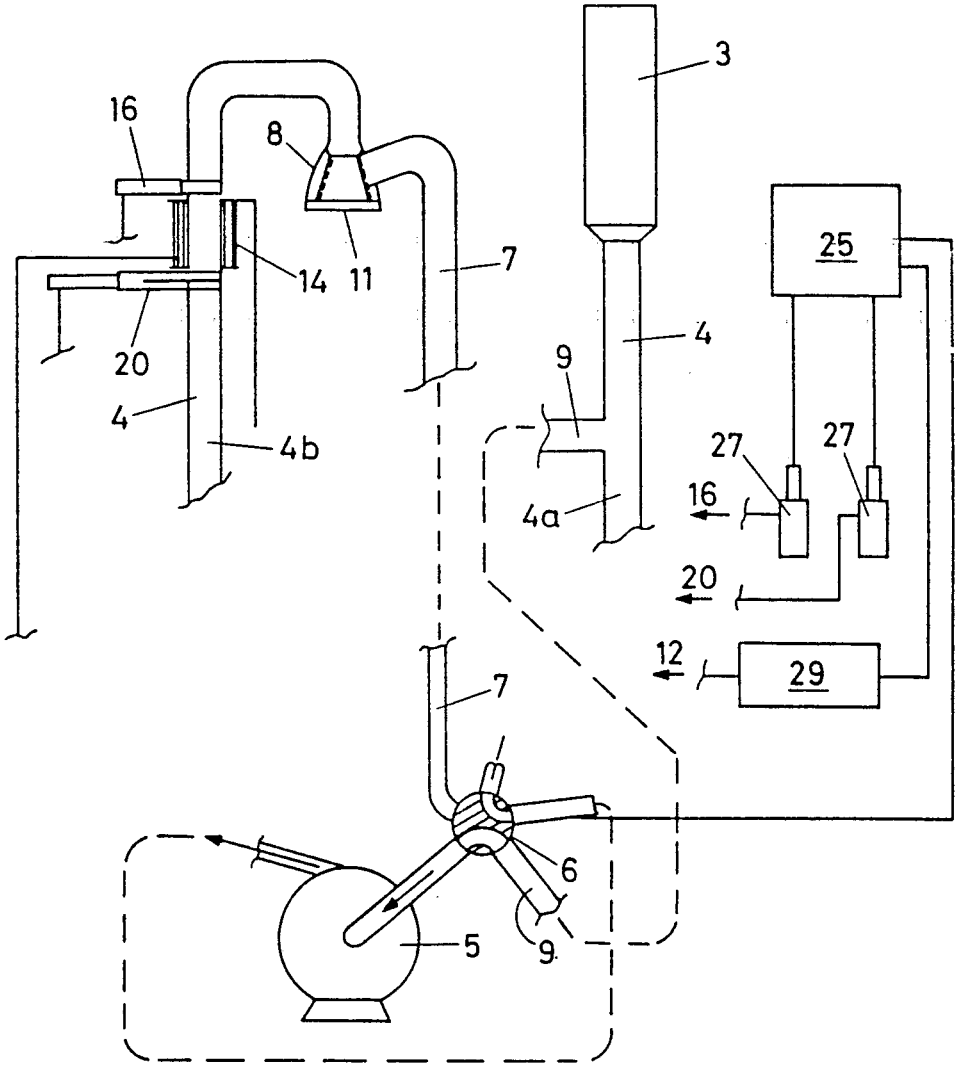
FIG. 2 is a schematic lay-out of the apparatus of FIG. 1.

In a first position of the valve 6, as shown in FIG. 2, the downward leg 4*a* is connected by the by-pass 9 so that in normal knitting suction is conveyed to the knitting cylinder 3 but not to the trap 8 or the upward leg 4*b*. Air is blown to atmosphere from the fan 5, through the valve 6. On pressing off, the valve 6 is switched to a second position so that suction is conveyed from the trap 8, through the hose 7 to the fan 5, and the fan blows its exhaust through the by-pass 9 into the downward leg 4*a*, through the lower section of the U-tube 4 (not shown) into the upward leg 4*b* and out through the door 11.

Figure 3:
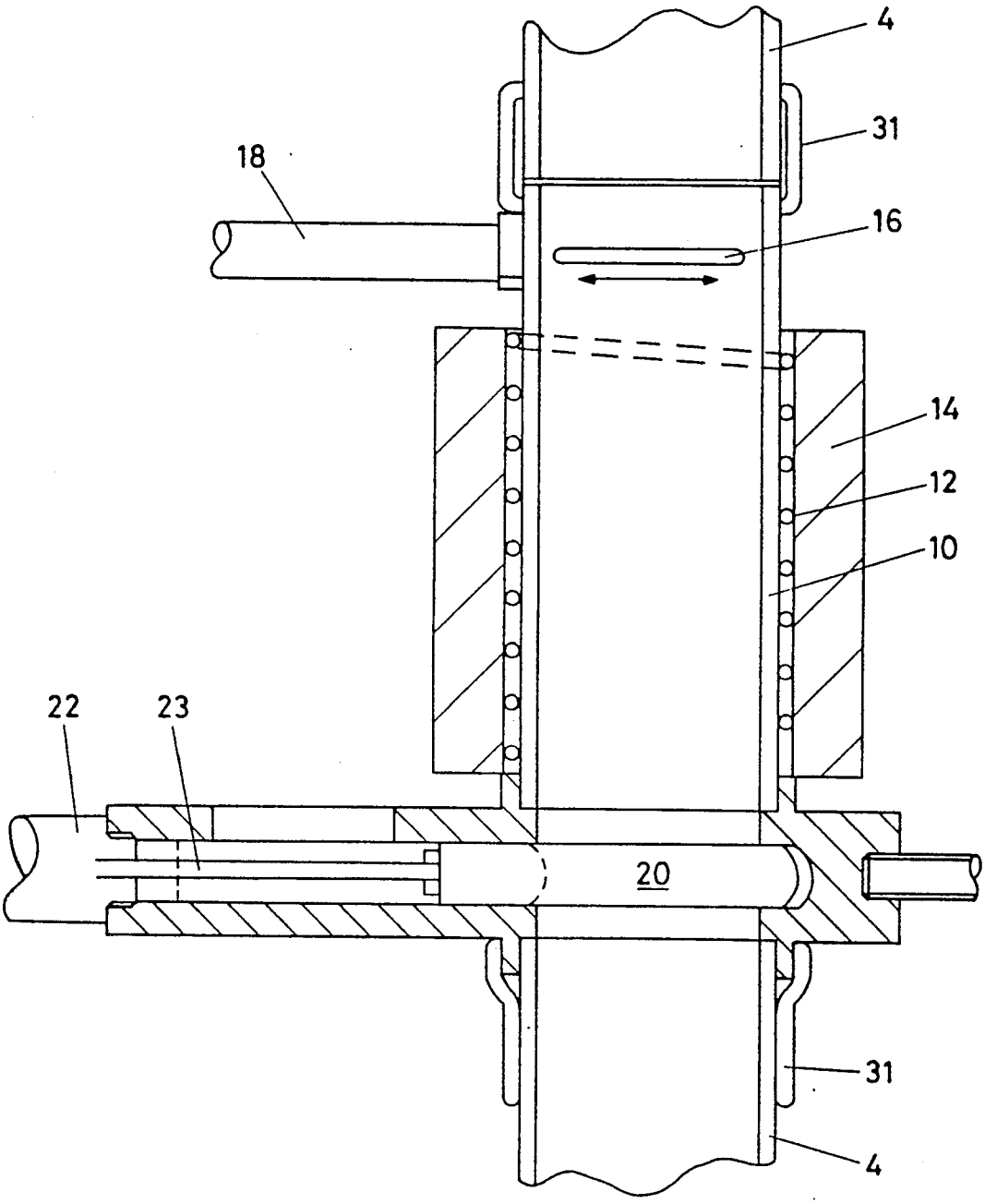
FIG. 3 is a section through the apparatus of FIG. 1 enlarged.

As shown in FIG. 3, a relaxation chamber 10 is connected into the upward leg 4*b* by sealing sleeves 31. At the bottom, a pneumatically operated slide 20 forms a barrier to block flow of air through the tube 4. The chamber 10 comprises a copper sleeve 10 which is heated by means of a resistance element 12 wrapped around the sleeve and insulated from the atmosphere by a sleeve 14. A pair of parallel control rods 18, operable by piston and cylinder devices (not shown), move a slide 16 above the chamber 10 to form a barrier to knitted articles but not to airflow. A piston and cylinder device 22 similarly controls a slide 20 by means of a rod 23.

In operation, starting at the stage (FIG. 4*a*) at which the knitting machine is about to press off an article which has just been knitted, the slides 16 and 20 will both be open to provide a free passage to the trap 8. The slides 16, 20 are operated by a system 25 (FIG. 2) of the knitting machine through solenoid air valves 27 for the respective piston and cylinder devices. The butterfly valve 6 is also operated through the system 25.

Next (FIG. 4*b*), the butterfly valve 6 is operated by the system 25 to cause air to flow through the lower section of the U-tube 4. Any article 37 in the chamber 10 is blown out and conveyed to the trap 8. As soon as the article 37 has been removed from the chamber 10, the piston and cylinder devices for the slide are operated to project substantially diametrically through the U-tube 4 causing the pressed-off article (shown at 39 in FIG. 4*c*) to be trapped in the sleeve 10. The resistance elements 12 may be under a constant current for a duration, and temperature controllable by the system 25, and tend to heat the contents of the chamber, although the continuing flow of air at this stage tends to reduce the temperature which can be achieved. Alternatively a control arrangement 29 (FIG. 2) may be provided to ensure that a consistent temperature is maintained.

Figure 4A:
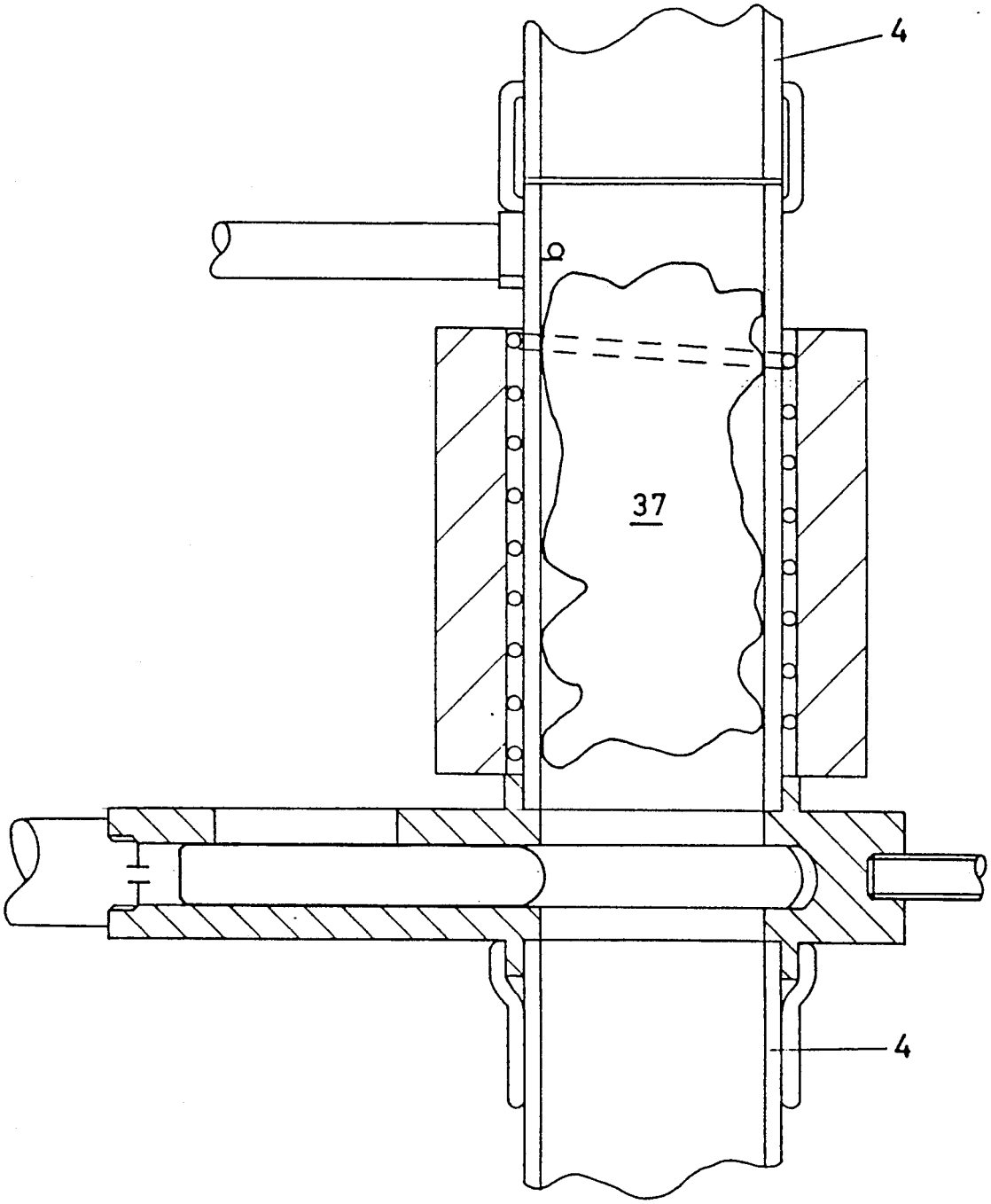
Figure 4B:
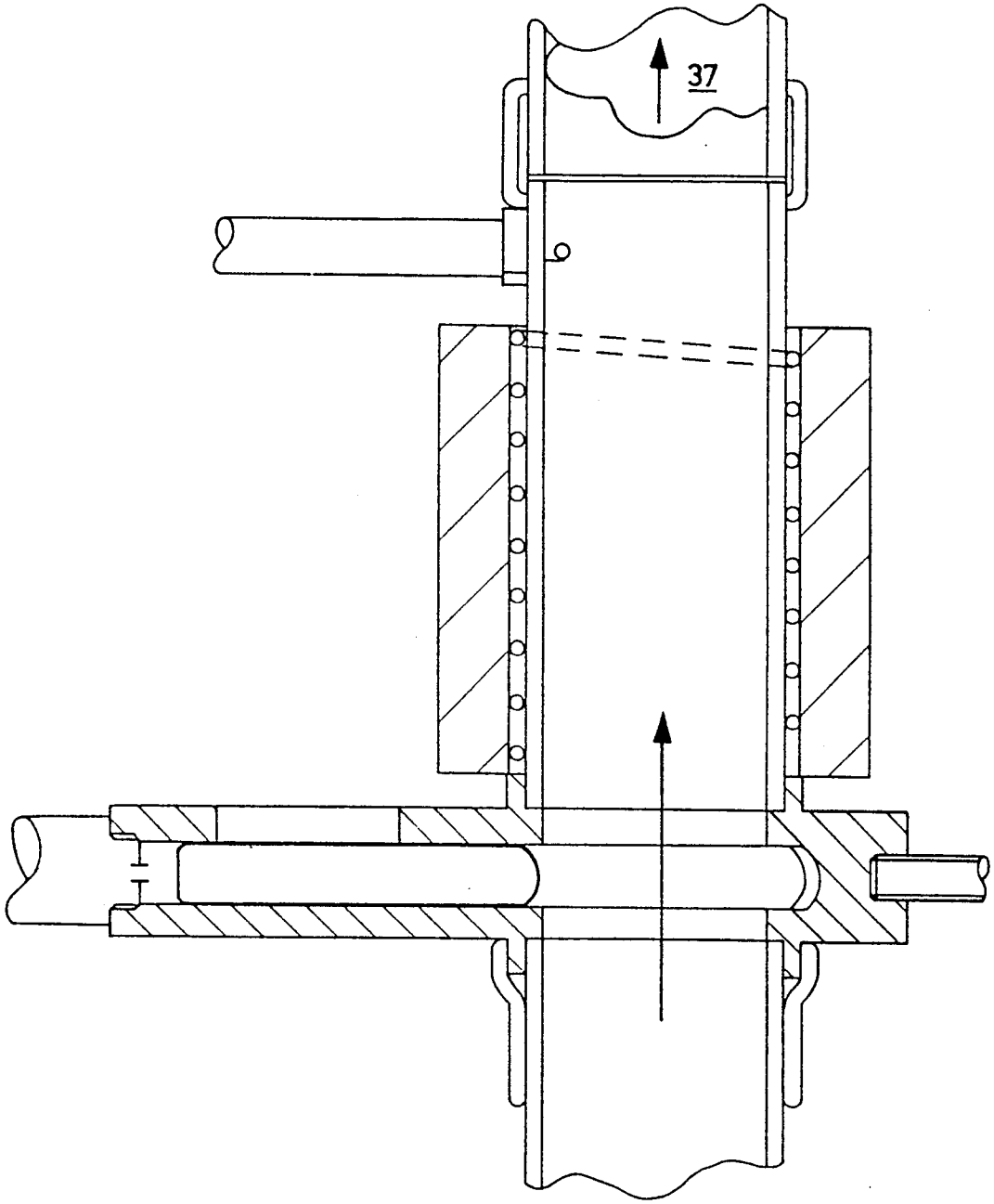
Figure 4C:
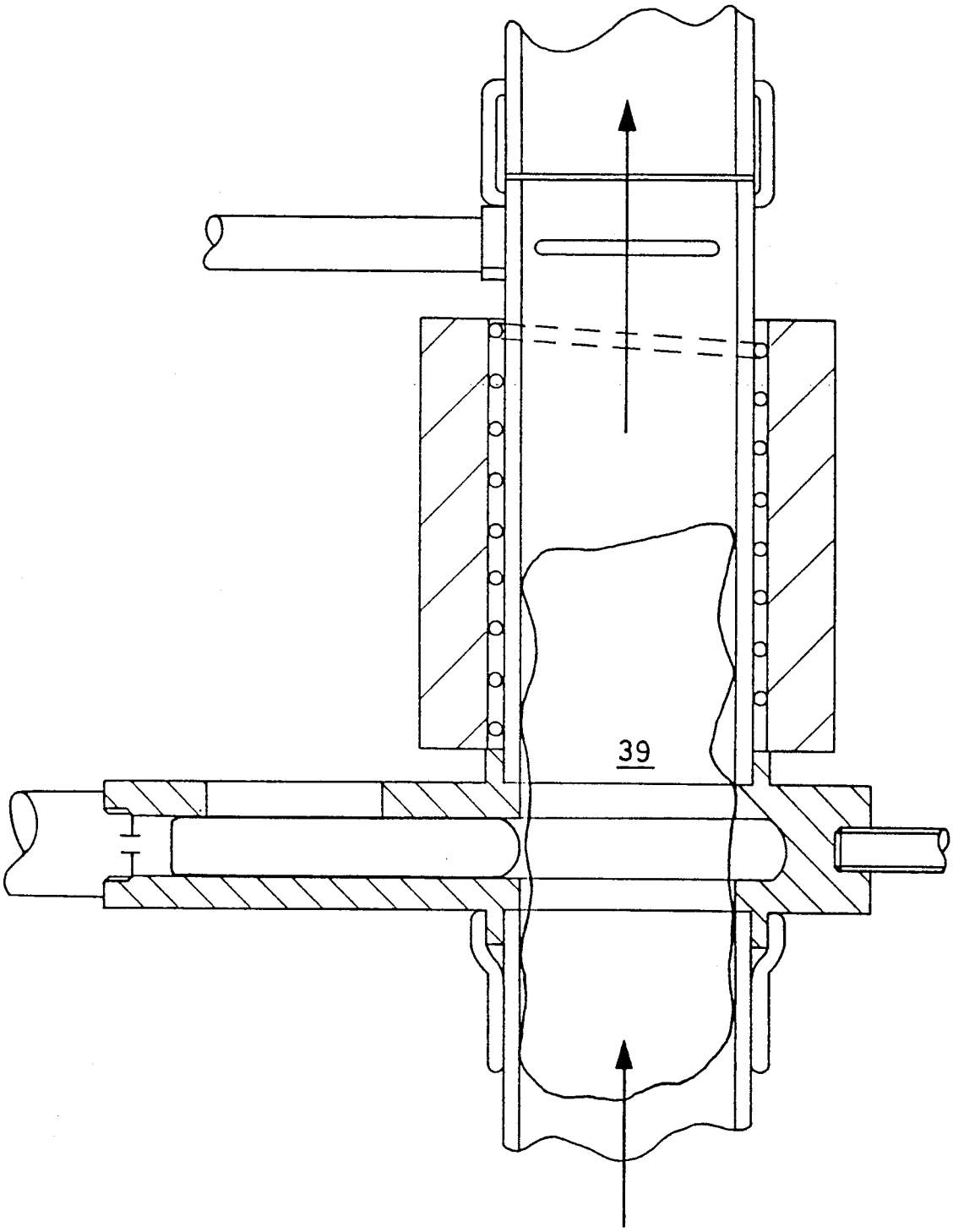
Figure 4D:
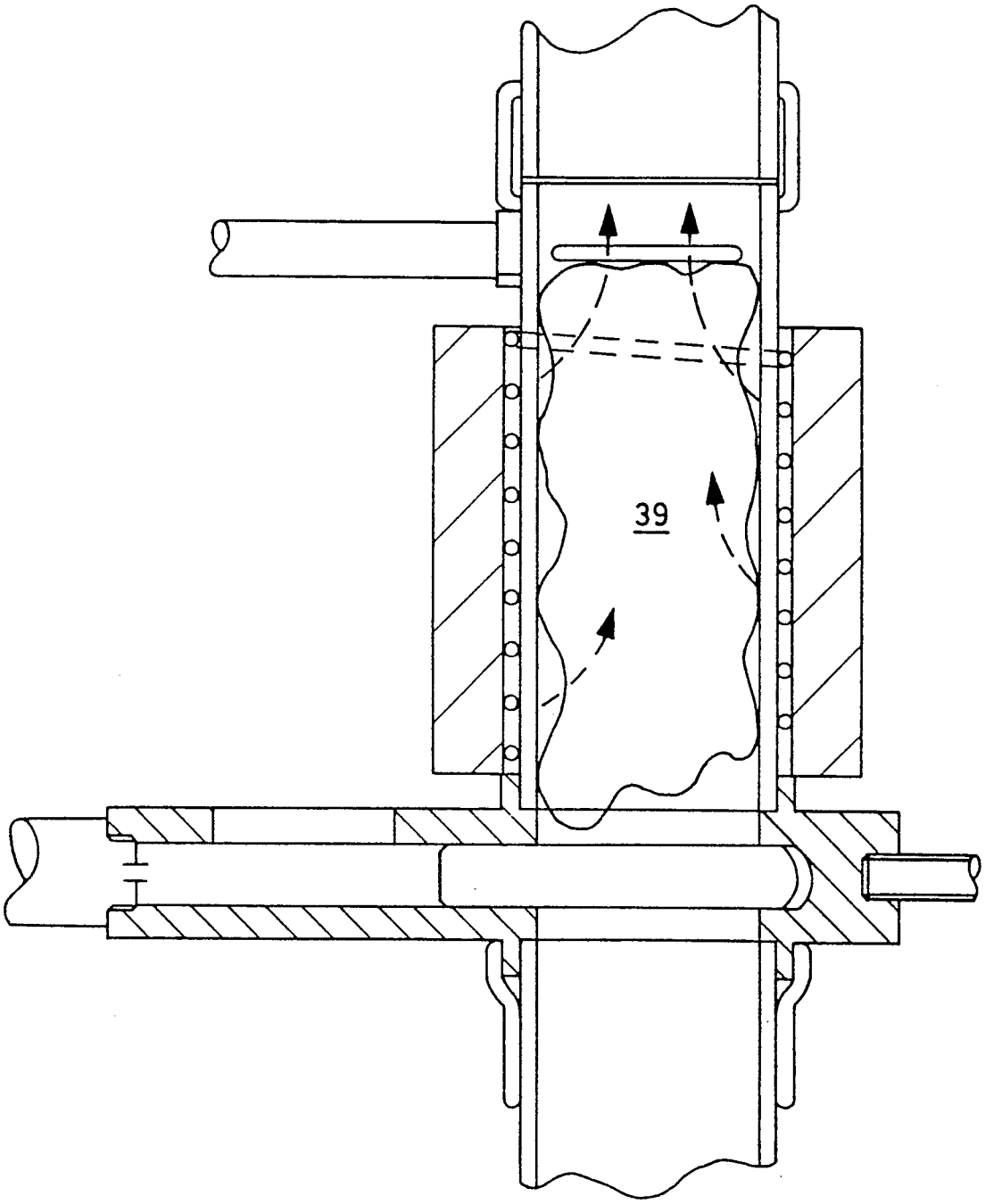
Figure 4E:
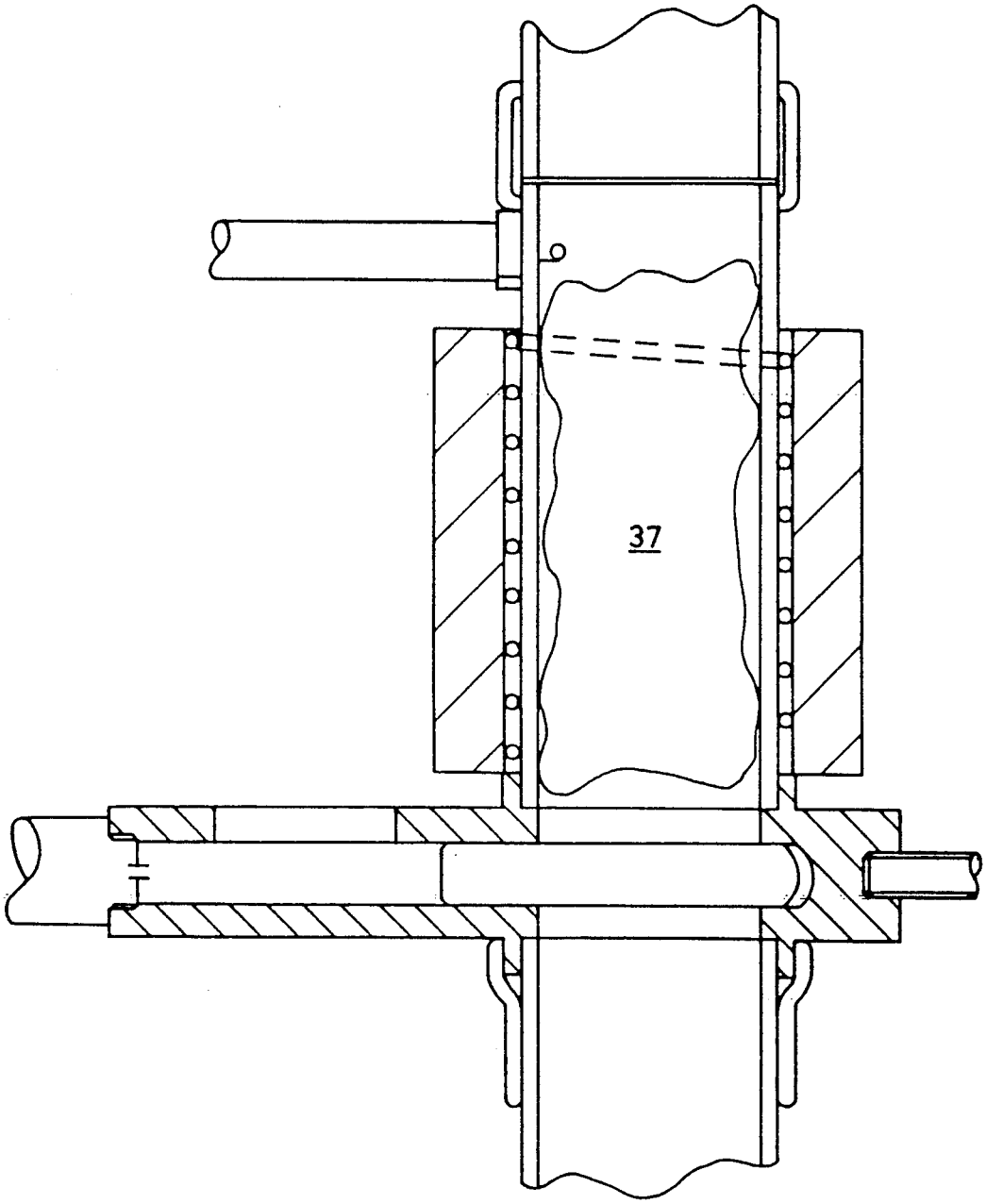

Next as the knitting machine reaches the stage where the welt is turned, the valve 6 is again operated to establish the normal suction take-down condition for knitting. The piston and cylinder device 22 operates the rod 27 to shift the slide 20 across the U-tube 4 (FIG. 4*d*). As a result, air can no longer pass through the tube 4, and the air in the sleeve 10 gradually heats up and rises by convection (see the dashed arrows) through the article 39 held in mildly folded condition underneath the slide 16 which now can be withdrawn (FIG. 4*e*). At the end of the heating cycle the slide 20 is withdrawn. The cycle can then be repeated Typically the heating process lasts for a period of two minutes (concurrently with the knitting cycle) and leads to a temperature of something in the region of 85 or to 120 C. for shorter knitting cycles. Preferably the duration of heating is matched to that of the knitting cycle so that the introduction of the newly pressed-off article into the sleeve 10 can be achieved at the same time by the well timed introduction of the rods 18. The U-tube arrangement is such that there is a gap between the old (shrunk) article and the new (pressed off) article which permits the slide 16 to be introduced without catching an article. Because there is no flow of air through the chamber !0, the heating effect desired can be achieved with a fairly low current consumption.

Whilst the article is folded inside the chamber, it is not crumpled and the gradual heating, mainly by convection, causes even shrinking of the article without the formation of excessive creases which could give apermanent effect on the appearance of the finished article. The heating conditions should be selected such that a smooth fabric finish is obtained and parts of the fabric do not adhere to one another.

In the fully projected condition of the rods 18 the slide 16 only stretches across part of the way of the tube 4 (see FIG. 3) so that there is no opportunity for the fabric to become trapped and damaged in the operation. The rods 18 are withdrawn through tight holes so as to prevent any damage to the fabric on their withdrawal.

The invention could be modified by modifying the heating arrangement, for example by using a ceramic sleeve and/or by introducing a degree of agitation into the chamber for ensuring and aiding the even spread of heat through the article.

It is to be noted that the duration of heating and the variation of temperature can be varied as required in step with the production of knitted articles on the knitting machine in a convenient manner. Full control over the processing conditions can thus be achieved so as to give an optimal effect. Considerable strength characteristics can be imparted whilst at the same time reducing the size variations from one article to the next. The relaxation and shrinkage achieved is relatively mild compared with that achievable by tumbling, yet a superior article can be surprisingly obtained together with the advantages of easier manipulation of the articles during any seaming operation for making tights. The apparatus can be retrofitted on existing machines, and requires little or no additonal space, whilst avoiding the handling and storage requirements attendant upon the use of the tumbling process. The gently reproducible heating treatment of the knitted article immediately after knitting provides advantages in finishing compared with the more laborious previous finishing procedure which incorporated tumbling.

I claim:

1. Apparatus for finishing hosiery articles (37) including a chamber (10) for causing relaxation of articles (37) in it, means (31) for connecting the chamber (10) to a take-down tube (4) of a knitting machine (2) for receiving articles (37) from the knitting machine (2), and means (25) for controlling the exit of articles (37) from the chamber (10) in synchronization with a knitting cycle of the knitting machine (2) characterized in that a fan (5) is connected through a valve (6) to the take-down tube (4) and to the chamber (10), the valve (6) having a first position in which the fan (5) draws air through a by-pass (9) from the take-down tube (4), and a second position in which the fan (5) draws air through a trap (8) from the chamber (10) and blows air through the by-pass (9) into the take-down tube (4).

2. Apparatus according to claim i in which the chamber (10) is in an upward leg (**4*b*) of the take-down tube (4**).

3. Apparatus according to claim i or claim 2 in which the chamber (10) is provided with a servo-operable barrier which can be moved selectively over the chamber outlet to permit the next article (37) to be conveyed by suction into the chamber (10).

* * * * *